US007857353B2

(12) United States Patent
Kuranda et al.

(10) Patent No.: US 7,857,353 B2
(45) Date of Patent: Dec. 28, 2010

(54) INDEX LABEL ASSEMBLY

(75) Inventors: Allison Kuranda, Belvidere, IL (US); Todd Davis, Marengo, IL (US)

(73) Assignee: Continental Datalabel, Inc., Elgin, IL (US)

( * ) Notice: Subject to any disclaimer, the term of this patent is extended or adjusted under 35 U.S.C. 154(b) by 543 days.

(21) Appl. No.: 11/820,733

(22) Filed: Jun. 20, 2007

(65) Prior Publication Data

US 2008/0061548 A1 Mar. 13, 2008

Related U.S. Application Data

(60) Provisional application No. 60/815,047, filed on Jun. 20, 2006.

(51) Int. Cl.
*B42F 21/00* (2006.01)
*G09F 3/00* (2006.01)

(52) U.S. Cl. ..... 283/81; 283/100; 283/36; 428/43

(58) Field of Classification Search ..... 283/36–43, 283/81, 900; 428/40.1, 42.1–42.3, 43; 235/486, 235/445, 442, 432, 375
See application file for complete search history.

(56) References Cited

U.S. PATENT DOCUMENTS

| | | | | |
|---|---|---|---|---|
| 5,182,152 | A * | 1/1993 | Ericson | 428/40.9 |
| 5,900,610 | A * | 5/1999 | Kelly, Jr. | 235/385 |
| 6,357,651 | B1 | 3/2002 | Flynn et al. | |
| 2004/0166286 | A1 * | 8/2004 | Auchter et al. | 428/136 |
| 2005/0089663 | A1 * | 4/2005 | Wong et al. | 428/42.3 |

* cited by examiner

*Primary Examiner*—Dana Ross
*Assistant Examiner*—Pradeep C Battula
(74) *Attorney, Agent, or Firm*—Pauley Petersen & Erickson

(57) ABSTRACT

A label assembly including a face sheet, a back sheet, and a layer of adhesive disposed between the face sheet and the back sheet. The adhesive adheres to the face sheet more than to the back sheet. A plurality of label shapes is cut within a remaining portion of the face sheet in a label column. A fold line extends across the label shapes in the label column. The fold line can be a printed line, a score line, a perforated line, and combinations thereof. The fold line divides each of the label shapes into a first portion and a second portion, where the first portion is larger than the second portion. The smaller second portion is folded back onto the first portion to form an index label for adhering to a separate page.

18 Claims, 4 Drawing Sheets

INDEX LABEL ASSEMBLY

CROSS REFERENCE TO RELATED APPLICATION

This application claims the benefit of U.S. Provisional Patent Application, Ser. No. 60/815,047, filed on 20 Jun. 2006. The co-pending Provisional patent application is hereby incorporated by reference herein in its entirety and is made a part hereof, including but not limited to those portions which specifically appear hereinafter.

BACKGROUND OF THE INVENTION

This invention is directed to an index label that can be adhered to a page or sheet, and that extends past an edge of the page or sheet. The invention is also directed to a printable sheet of such labels, and a method for printing and folding the printed labels, such as by a consumer, to form an index label.

SUMMARY OF THE INVENTION

A general object of the invention is to provide a printable sheet of removable index labels.

The general object of the invention can be attained, at least in part, through a label assembly. The label assembly includes a face sheet, a back sheet, and a layer of adhesive disposed between the face sheet and the back sheet. The adhesive adheres to the face sheet more than to the back sheet. A plurality of label shapes is cut within a remaining portion of the face sheet. The label shapes include at least a first label column. A fold line extends across the label shapes in the first label column. The fold line can be a printed line, a score line, a perforated line, and combinations thereof. Desirably, the fold line divides each of the label shapes into a first portion and a second portion, where the first portion is larger than the second portion.

The invention further comprehends a method of using the label assembly of this invention. The method including feeding the label assembly through a printer operatively connected to a computer, printing on the face sheet within the plurality of label shapes, removing one or more of the label shapes from the remaining portion, folding the one or more label shapes about the fold line to adhere a first portion of the labels shape to a second portion of the label shape, and adhering the label shape, by a portion of the first portion that is not covered, to an object, such as a sheet of paper.

The invention still further comprehends a label assembly. The label assembly includes a face sheet, a back sheet, and a layer of adhesive disposed between the face sheet and the back sheet. The adhesive adheres to the face sheet more than to the back sheet. A plurality of label shapes is cut within a remaining portion of the face sheet. The label shapes including at least a first label column and a second label column. A first fold line extends across the label shapes of the first label column and a second fold line extends across the label shapes of the second label column. The first and second label columns and the first and second fold lines are arranged lengthwise on the label assembly.

BRIEF DESCRIPTION OF THE DRAWINGS

These and other objects and features of this invention will be better understood from the following description taken in conjunction with the drawings.

DESCRIPTION OF THE DRAWINGS

Figure 1:
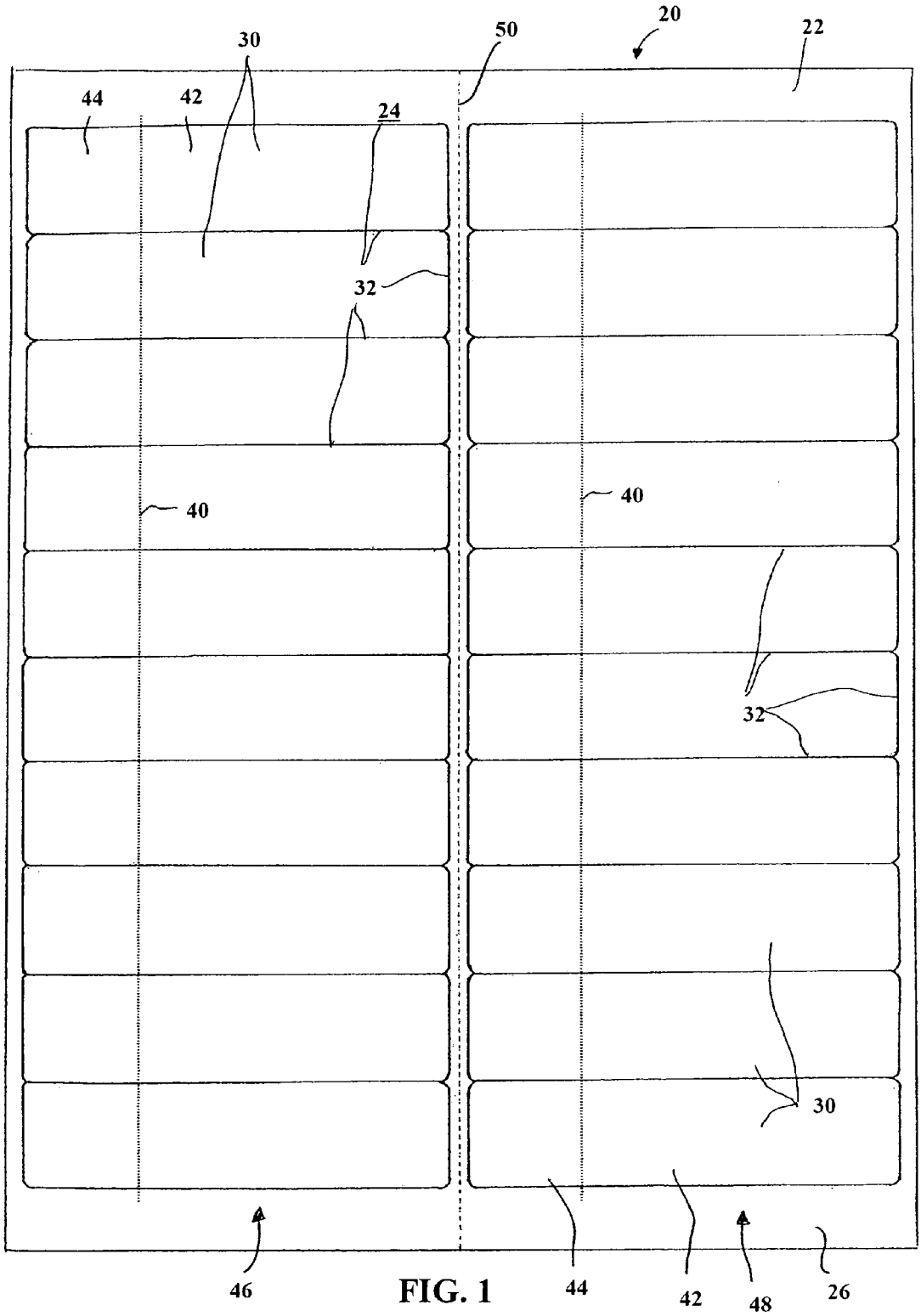
FIG. 1 is a plan view of a label assembly according to one embodiment of this invention.

FIG. 1 illustrates a label assembly 20 (not necessarily shown to scale) according to one embodiment of this invention. Label assembly 20 is desirably formed of a face sheet 22 and a back sheet (not shown). The back sheet is desirably about the same size as the face sheet 22, but may be slightly larger or smaller than the face sheet 22. The surface of the face sheet 22 that is disposed toward the back sheet includes an adhesive coating. The adhesive coating can include any adhesive material known and available to those skilled in the art for forming pressure sensitive, or self-adhesive labels. The back sheet is desirably formed of a material to which the adhesive coating adheres significantly less than to the face sheet 22, such as is known for forming pressure sensitive, or self-adhesive labels.

The sheet 20 is of any suitable shape, and generally any suitable size that can be accepted by and fed through a printer, such as a laser printer or an ink jet printer. Common sizes of paper generally fed through printers are 8.5 inches by 5.5 inches, 8.5 inches by 11 inches, 8.263 inches by 11.688 inches (A4 size), and 8.5 inches by 14 inches. The face sheet 22 is preferably, but not necessarily, constructed of any suitable paper, paper composite, non-metal and/or metal material that can be used as a label. Other suitable materials for constructing the sheet 22 include fabric, plastic, and metal foils. The adhesive coating covered by the back sheet is applied to the face sheet 22 in any suitable manner known to those skilled in the art. The face sheet 22 desirably has a printable surface 24 on a side opposite the adhesive coating.

The face sheet 22 and the printable surface 24 can be any of a variety of face materials used to make pressure sensitive, or self-adhesive labels. Such face materials may include, but are not limited to: smudgeproof stock, litho stock, cast coated stock, tag stock, fluorescent stock, foils, computer printable polyester, vinyl, satin cloth, Tyvek™ material, flexible plastic, book papers, photo quality papers and/or photo quality film. Furthermore, various portions of the face materials can be different colors, thereby resulting in different colored parts.

The phrase "printable surface" relates to a surface of any type of matter upon which a person or machine can draw, print, color, paint, photocopy, write, emboss, or make any other type of mark or graphic. Laser printers, ink jet printers, impact printers, thermal transfer printers, direct thermal printers, typewriters, or any other suitable graphic printing devices are preferred but not necessary for use with printable surfaces according to this invention.

The face sheet 22 includes a plurality of shapes 30, each defining an individual label according to this invention. The phrase shape, or the phrase removable or tearable shape, is intended to relate to a shape, such as the shapes identified in FIG. 1 by element reference numerals 30, that can be torn away from a remaining portion 26 of the sheet 22, by using tearable lines of separation 32, such as die-cut lines, perforated lines, micro-perforated lines, or any combination of these types of separation, or any other suitable structure that enables separation. A preferred type of tearable line 32 is a line that is die-cut. The label shapes 30 can be die-cut along at least a portion of a periphery, such that the label shapes 30 can be easily removed or separated from the remaining portion 26 of the sheet 22, for example after the sheet 22 is run through a printer.

The face sheet 22 includes two fold lines 40. Each of the fold lines 40 extends across a corresponding plurality of label shapes 30, such that upon removing a label shape 30, the removed label shape 30 includes a portion of the fold line 40. The fold line 40 divides each of the label shapes 30 into a first portion 42 and a second portion 44. Desirably, the second portion 44 is sized smaller than the first portion 42. The fold lines 40 can be embodied in various and alternative ways, such as are known by those skilled in the art. In the embodiment shown in FIG. 1, the fold lines 40 are printed on the face sheet 22. In another embodiment of this invention, the fold lines 40 optionally include a score line or a perforated line, alone or in combination with the printed fold line, that desirably facilitates folding along the fold lines 40 upon removing the individual labels 30 from the sheet 20.

The label assembly 20 shown in FIG. 1 includes a first column 46 of label shapes 30 and a second column 48 of label shapes 30. Each of the first and second label columns is arranged or stacked lengthwise on the label assembly 20, and each includes a fold line 40 extending across the label shapes. The label assembly 20 also includes an optional separation line 50 dividing the two columns 46 and 48 into two sets of label shapes 30. The separation line 50 allows the label assembly 20 to be separated in two by the user, if desired depending on need, either before of after printing on the printable surface 24. In one embodiment of this invention, the separation line 50 is formed by a first tearable line of separation extending across the face sheet and a second tearable line of separation extending across the back sheet. The separation line 50 is desirably formed by a perforated line of separation including a plurality of cuts and ties.

Figure 2:
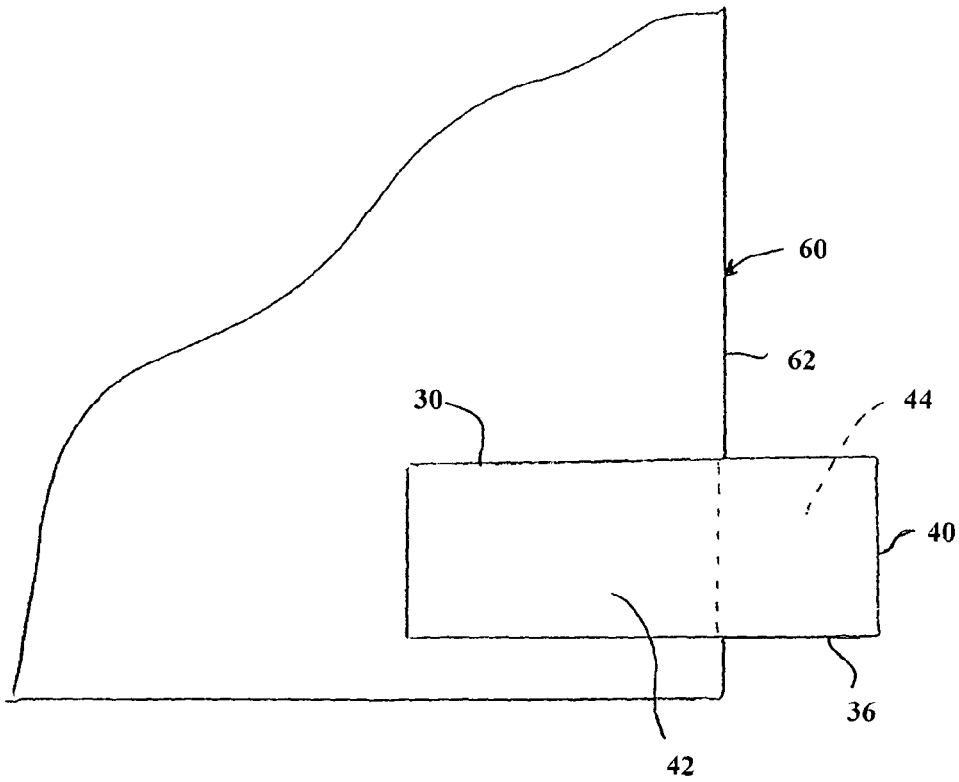
FIG. 2 illustrates a label according to one embodiment of this invention attached to a separate material sheet.

FIG. 2 illustrates a removed and folded label shape 30 attached to a paper 60 (partially shown) as an index label 30, according to one preferred embodiment of this invention. The second portion 44 of the label 30 is folded about fold line 40, such that the adhesive coated side of the second portion 44 is adhered to and covers a portion of the adhesive coated side of the first portion 42 of the label 30. The remaining portion of the adhesive side of the label first portion 42 (i.e., that which is not adhered to the label second portion 44) is adhered to the paper 60. The label 30 is attached to the paper 60 such that a tab portion 36 of the label 30 extends beyond an edge 62 of the paper 60. The tab portion 36 is formed by the label second portion 44 folded back onto the portion of the label first portion 42. The formed tab portion 36 thus includes two printable surfaces (at least one of which is typically printed on, if desired, in FIG. 2), one on either side of the tab portion 36. The tab portion 36 desirably does not include any exposed adhesive material.

Figure 3:
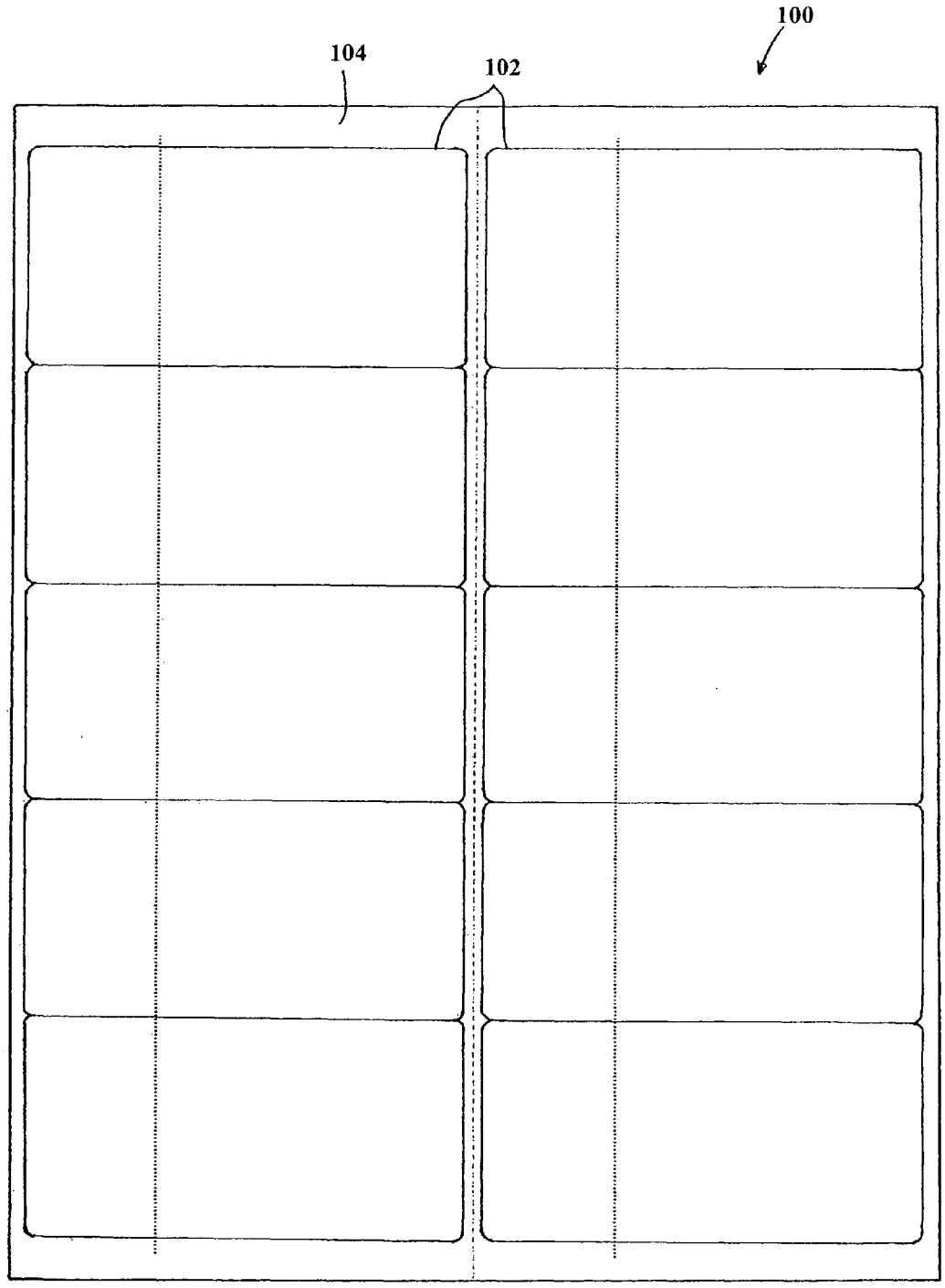
FIG. 3 is a plan view of a label assembly according to another embodiment of this invention.

As will be appreciated by those skilled in the art following the teachings herein provided, various and alternative sizes, shapes, and configurations are available for the label assembly, label columns, and label shapes of this invention. As an example, FIG. 3 illustrates a label assembly 100 (not necessarily shown to scale) according to another embodiment of this invention. The embodiment shown in FIG. 3 generally differs from the embodiment discussed above with reference to FIG. 1, in the size and number of the plurality of shapes 102 cut into the face sheet 104. As a further example, in one embodiment of this invention, the second portion of the label shape of this invention, which is the portion intended to extend beyond the page the label is adhered to, can have a fanciful shape, such as a star or circle, for which the first portion of the label shape includes a matching shape with an additional extension portion for adhering to a paper.

Figure 4:
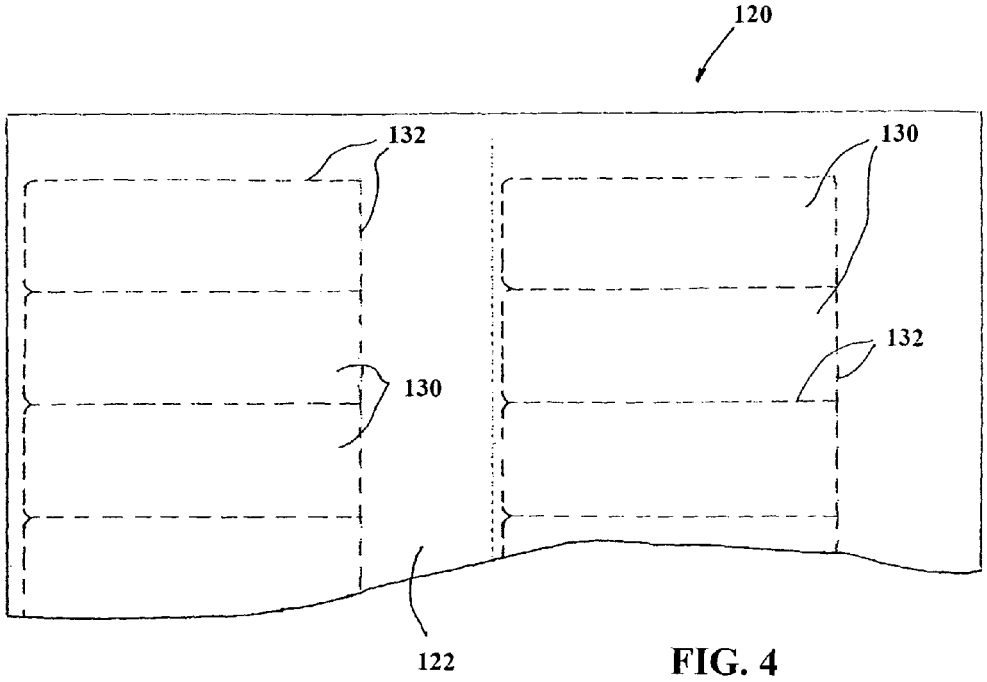
FIG. 4 is a partial view of a label assembly according to another embodiment of this invention.
Figure 5:
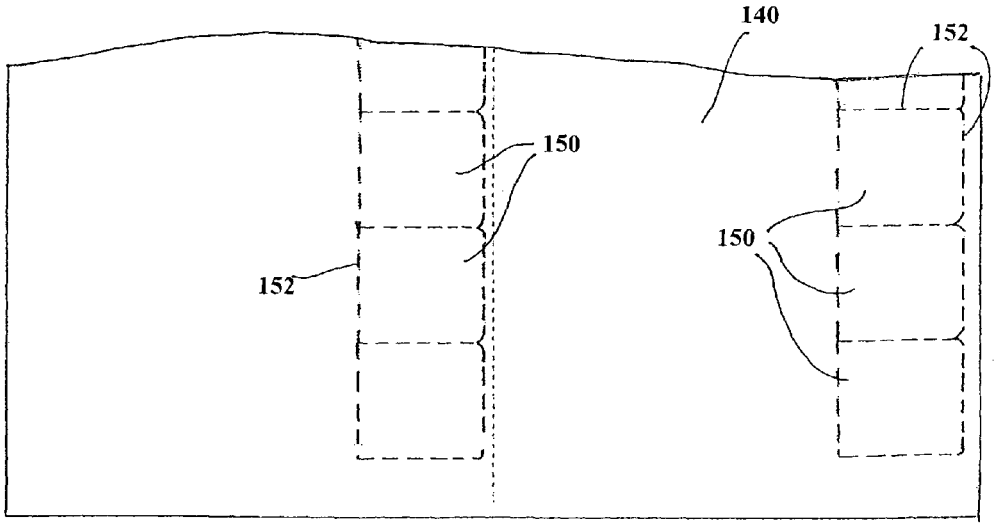
FIG. 5 is a partial view of a label assembly according to another embodiment of this invention.

In one embodiment of this invention, the back sheet includes tearable lines aligned with at least portion of the tearable lines defining label shapes 30 on the front face sheet 22, such that the label shapes 30 can be removed with a portion of the back sheet attached thereto, for facilitating folding and adhering of the label portion back against the label. FIGS. 4 and 5 illustrate two exemplary embodiments in this regards. FIG. 4 is a rear view of a portion of a label assembly 120, which is similar in label configuration to label assembly 20 of FIG. 1. In FIG. 4, the back sheet 122 includes a plurality of shapes 130 cut therein. Each of the shapes 130 is defined by tearable lines of separation 132, which are shown as perforated lines. The shapes 130 are sized, shaped, and aligned with a first portion of a label according to the label size and shape shown in FIG. 1. FIG. 5 illustrates an alternative example, where the plurality of shapes 150 cut in the back sheet 140 by perforated line 152 are sized, shaped, and aligned with a second portion of a label according to the label size and shape shown in FIG. 1.

Thus, the invention provides an index label and a printable sheet of shapes for forming user-printed labels that can be folded into and used as index labels.

It will be appreciated that details of the foregoing embodiment, given for purposes of illustration, is not to be construed as limiting the scope of this invention. Although only a few exemplary embodiments of this invention has been described in detail above, those skilled in the art will readily appreciate that many modifications are possible in the exemplary embodiments without materially departing from the novel teachings and advantages of this invention. Accordingly, all such modifications are intended to be included within the scope of this invention. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

What is claimed is:

1. A label assembly, comprising:

a face sheet, a back sheet, and a layer of adhesive disposed between the face sheet and the back sheet, the adhesive adhering to the face sheet more than to the back sheet;

a plurality of label shapes cut within a remaining portion of the face sheet, the label shapes including at least a first label column;

a fold line extending across the label shapes in the first label column, the fold line dividing each of the label shapes into a first portion and a second portion; and a plurality of shapes cut within the back sheet and aligned in a column that backs to a portion of the first label column, wherein each of the plurality of shapes is aligned with at least a portion of the first portion or the second portion of one of the label shapes and each of the plurality of label shapes comprises a label outer periphery formed at least in part by a first tearable line of separation in the face sheet, each of the plurality of shapes comprises a shape outer periphery formed at least in part by a second tearable line of separation in the back sheet, and at least a portion of the second tearable line extends along a portion of the first tearable line of separation.

2. The label assembly of claim 1, wherein the fold line comprises a printed line, a score line, a perforated line, and combinations thereof.

3. The label assembly of claim 1, wherein the label assembly is approximately 8.5 inches by 11 inches or approximately A4 sized.

4. The label assembly of claim 1, wherein the first label column is arranged lengthwise on the label assembly.

5. The label assembly of claim 1, further comprising a second label column and a second fold line extending across the label shapes in the second label column, wherein the second fold line comprises a printed line, a score line, a perforated line, and combinations thereof.

6. The label assembly of claim 5, further comprising a separation line disposed between the first and second label columns, the separation line dividing the label assembly into two portions.

7. The label assembly of claim 6, wherein the separation line is formed by a first tearable line of separation extending across the face sheet and a second tearable line of separation extending across the back sheet.

8. The label assembly of claim 6, wherein the separation line comprises a plurality of cuts and ties.

9. The label assembly of claim 1, wherein the first portion is larger than the second portion.

10. The label assembly of claim 1, wherein the plurality of shapes are cut within the back sheet by lines of perforations.

11. The label assembly of claim 1, wherein the face sheet and back sheet are coextensive with respect to each other.

12. A method of using a label assembly including a face sheet, a back sheet, and a layer of adhesive disposed between the face sheet and the back sheet, the adhesive adhering to the face sheet more than to the back sheet, a plurality of label shapes cut within a remaining portion of the face sheet, the label shapes including at least a first label column, a fold line extending across the label shapes in the first label column, the fold line dividing each of the label shapes into a first portion and a second portion, and a plurality of shapes cut within the back sheet and aligned in a column that backs to a portion of the first label column, wherein each of the plurality of shapes is aligned with at least a portion of the first portion or the second portion of one of the label shapes, the method comprising:

feeding the label assembly through a printer operatively connected to a computer;

printing on the face sheet within the plurality of label shapes;

removing one or more of the label shapes from the remaining portion with a corresponding one of the plurality of shapes attached thereto;

folding the one or more label shapes about the fold line to adhere a first portion of the labels shape to a second portion of the label shape;

adhering the label shape to an object.

13. A method of using a label assembly including a face sheet, a back sheet, and a layer of adhesive disposed between the face sheet and the back sheet, the adhesive adhering to the face sheet more than to the back sheet, a plurality of label shapes cut within a remaining portion of the face sheet, the label shapes including at least a first label column, a fold line extending across the label shapes in the first label column, the fold line dividing each of the label shapes into a first portion and a second portion wherein the first portion is larger than the second portion, and a plurality of shapes cut within the back sheet and aligned in a column that backs to a portion of the first label column, wherein each of the plurality of shapes is aligned with at least a portion of the first portion or the second portion of one of the label shapes, the method comprising:

feeding the label assembly through a printer operatively connected to a computer;

printing on the face sheet within at least one of the first portion and a second portion of the plurality of label shapes;

removing one of the label shapes from the remaining portion with a corresponding one of the plurality of shapes cut within the back sheet attached thereto;

removing the corresponding one of the plurality of shapes from the removed one of the label shapes;

folding the one of the label shapes about the fold line to adhere the second portion to the first portion;

adhering a portion of the first portion to an object, wherein the second portion extends past an edge of the object.

14. A label assembly, comprising:

a face sheet, a back sheet, and a layer of adhesive disposed between the face sheet and the back sheet, the adhesive adhering to the face sheet more than to the back sheet;

a plurality of label shapes cut within a remaining portion of the face sheet, the label shapes including at least a first label column and a second label column;

a first fold line extending across the label shapes of the first label column, the first fold line dividing each of the label shapes of the first label column into a first portion and a second portion;

a second fold line extending across the label shapes of the second label column, the second fold line dividing each of the label shapes of the second label column into a first portion and a second portion;

the first and second label columns and the first and second fold lines arranged lengthwise on the label assembly; and a plurality of shapes cut within the back sheet, and including a first column that backs to a portion of the first label column and a second column that backs to a portion of the second label column, wherein each of the plurality of shapes is aligned with at least a portion of the first portion or the second portion of one of the label shapes, each of the plurality of label shapes comprises a label outer periphery formed at least in part by a first tearable line of separation in the face sheet, each of the plurality of shapes comprises a shape outer periphery formed at least in part by a second tearable line of separation in the back sheet, and at least a portion of the second tearable line extends along a portion of the first tearable line of separation.

15. The label assembly of claim 14, wherein each of the first and second fold lines comprises a printed line, a score line, a perforated line, and combinations thereof.

16. The label assembly of claim 14, wherein the fold line divides each of the label shapes into a first portion and a second portion, wherein the first portion is larger than the second portion.

17. The label assembly of claim 14, further comprising a separation line disposed between the first and second label columns, the separation line dividing the label assembly into two portions.

18. The label assembly of claim 17, wherein the separation line comprises a plurality of cuts and ties.

* * * * *